US010143277B1

(12) United States Patent
Ross

(10) Patent No.: US 10,143,277 B1
(45) Date of Patent: Dec. 4, 2018

(54) SELF DEFENSE UMBRELLA

(71) Applicant: Howard Ross, Lake Worth, FL (US)

(72) Inventor: Howard Ross, Lake Worth, FL (US)

( * ) Notice: Subject to any disclaimer, the term of this patent is extended or adjusted under 35 U.S.C. 154(b) by 0 days.

(21) Appl. No.: 15/900,453

(22) Filed: Feb. 20, 2018

(51) Int. Cl.

| | |
|---|---|
| ***F41H 5/08*** | (2006.01) |
| ***A45B 25/18*** | (2006.01) |
| ***A45B 25/02*** | (2006.01) |
| ***F41H 1/02*** | (2006.01) |
| ***G08B 25/01*** | (2006.01) |
| ***F41B 11/80*** | (2013.01) |
| *A45B 3/14* | (2006.01) |
| *A45B 25/00* | (2006.01) |

(52) U.S. Cl.
CPC ..... *A45B 25/18* (2013.01); *A45B 25/02* (2013.01); *F41B 11/80* (2013.01); *F41H 1/02* (2013.01); *F41H 5/08* (2013.01); *G08B 25/01* (2013.01); *A45B 3/14* (2013.01); *A45B 2025/003* (2013.01); *A45B 2200/1009* (2013.01)

(58) Field of Classification Search
None
See application file for complete search history.

(56) References Cited

U.S. PATENT DOCUMENTS

| | | | | |
|---|---|---|---|---|
| 5,727,583 | A | 3/1998 | Kennedy | |
| D393,539 | S | 4/1998 | Bridgen | |
| 5,986,872 | A | 11/1999 | Chaput | |
| 6,643,114 | B2 | 11/2003 | Stethem | |
| 6,691,601 | B2 | 2/2004 | Cohen | |
| 6,854,374 | B1 * | 2/2005 | Breazeale | F41H 5/08 102/502 |
| 2006/0097007 | A1 | 5/2006 | Motyka | |
| 2010/0083428 | A1 * | 4/2010 | McElroy | F41H 5/0428 2/456 |
| 2013/0247435 | A1 | 9/2013 | Bacik | |
| 2016/0337618 | A1 * | 11/2016 | Chapman | H04N 7/181 |
| 2018/0142924 | A1 * | 5/2018 | Limon | F25B 21/02 |

* cited by examiner

*Primary Examiner* — Stephen Johnson
(74) *Attorney, Agent, or Firm* — Kyle A. Fletcher, Esq.

(57) ABSTRACT

The self defense umbrella forms a defensive shield that blocks and deflects offensive projectiles directed at a person using the self defense umbrella. The self defense umbrella comprises a shield and a control system. The shield forms a physical barrier that blocks and deflects offensive projectiles directed at the person using the self defense umbrella. The control system: 1) captures images of the environment of the person using the self defense umbrella; 2) determines the GPS coordinates of the person using the self defense umbrella; 3) transmits the captured images and the GPS coordinates to an appropriate authority; 4) illuminates the environment of the person using the self defense umbrella; and, 5) operates a defensive firearm incorporated into the self defense umbrella.

19 Claims, 9 Drawing Sheets

SELF DEFENSE UMBRELLA

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including walking sticks and umbrellas, more specifically, an umbrella combined with one or more weapons.

SUMMARY OF INVENTION

The self defense umbrella is a safety device. The self defense umbrella is configured for use with a person. The self defense umbrella forms a defensive shield that blocks and deflects offensive projectiles directed at the person using the self defense umbrella. The self defense umbrella comprises a shield and a control system. The shield forms a physical barrier that blocks and deflects offensive projectiles directed at the person using the self defense umbrella. The control system: 1) captures images of the environment of the person using the self defense umbrella; 2) determines the GPS coordinates of the person using the self defense umbrella; 3) transmits the captured images and the GPS coordinates to an appropriate authority; 4) illuminates the environment of the person using the self defense umbrella; and, 5) operates a defensive firearm incorporated into the self defense umbrella. Each self defense umbrella further comprises an interlocking mechanism that allows a plurality of self defense umbrellas to be interlocked to expand the volume of protected space relative to the space protected by any individual self defense umbrella.

These together with additional objects, features and advantages of the self defense umbrella will be readily apparent to those of ordinary skill in the art upon reading the following detailed description of the presently preferred, but nonetheless illustrative, embodiments when taken in conjunction with the accompanying drawings.

In this respect, before explaining the current embodiments of the self defense umbrella in detail, it is to be understood that the self defense umbrella is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the self defense umbrella.

It is therefore important that the claims be regarded as including such equivalent construction insofar as they do not depart from the spirit and scope of the self defense umbrella. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
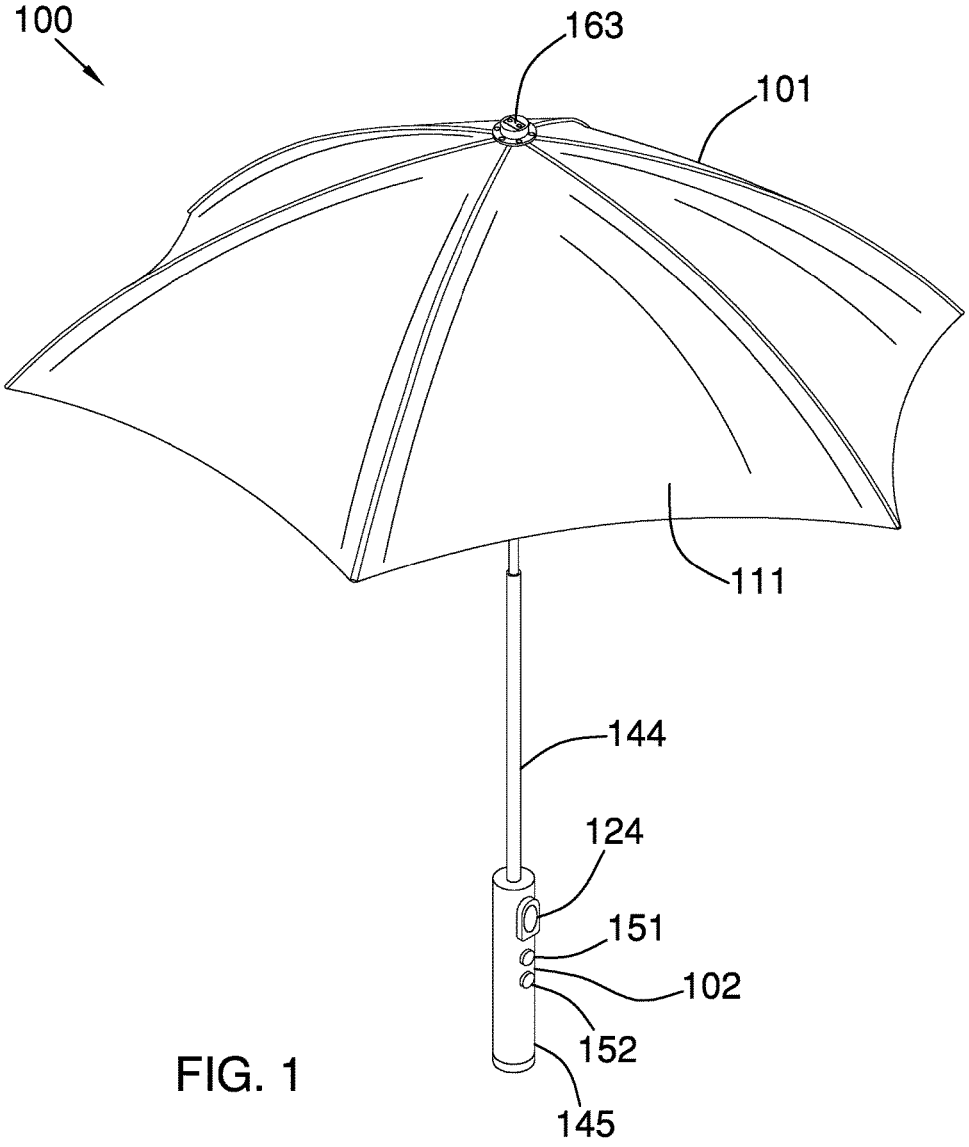
FIG. 1 is a perspective view of an embodiment of the disclosure.
Figure 2:
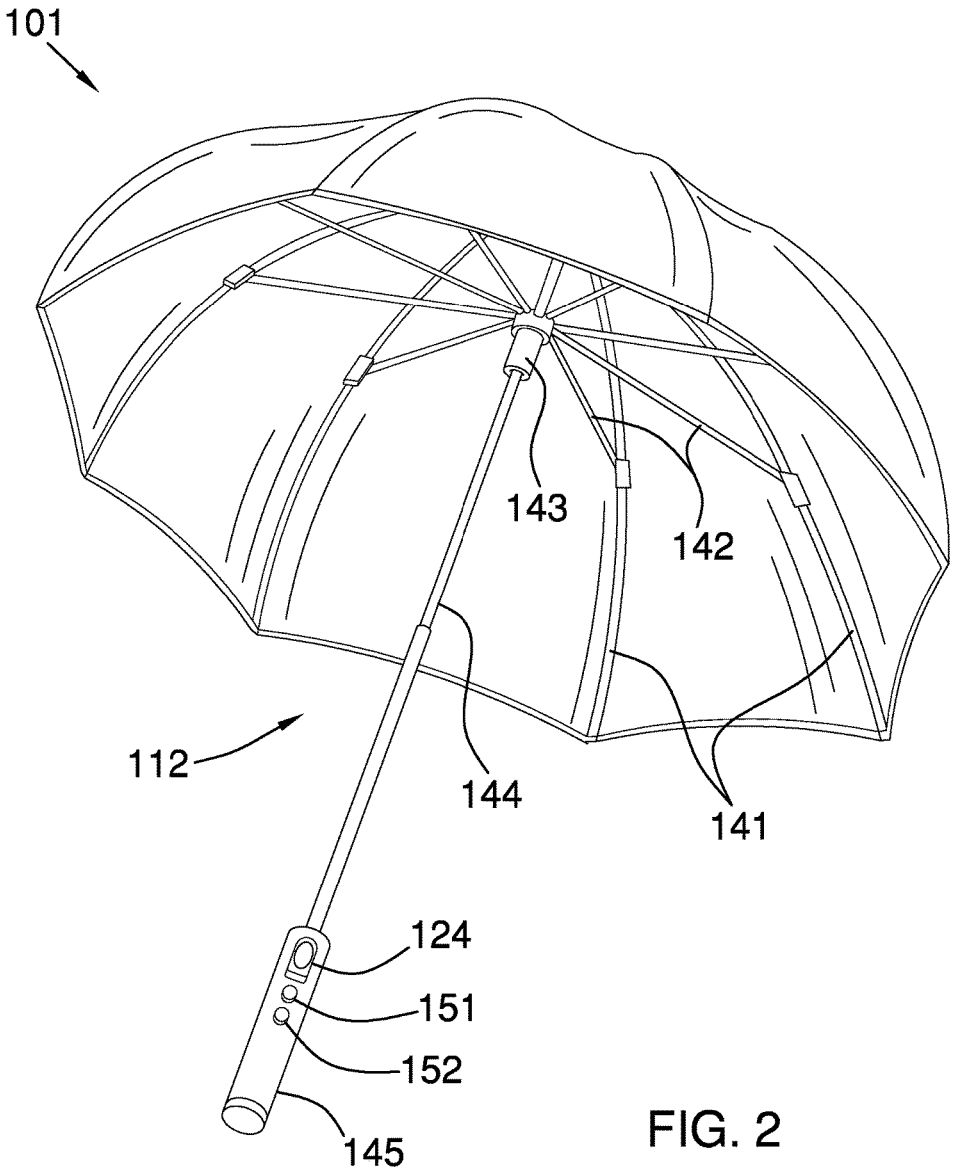
FIG. 2 is a reverse perspective view of an embodiment of the disclosure.
Figure 3:
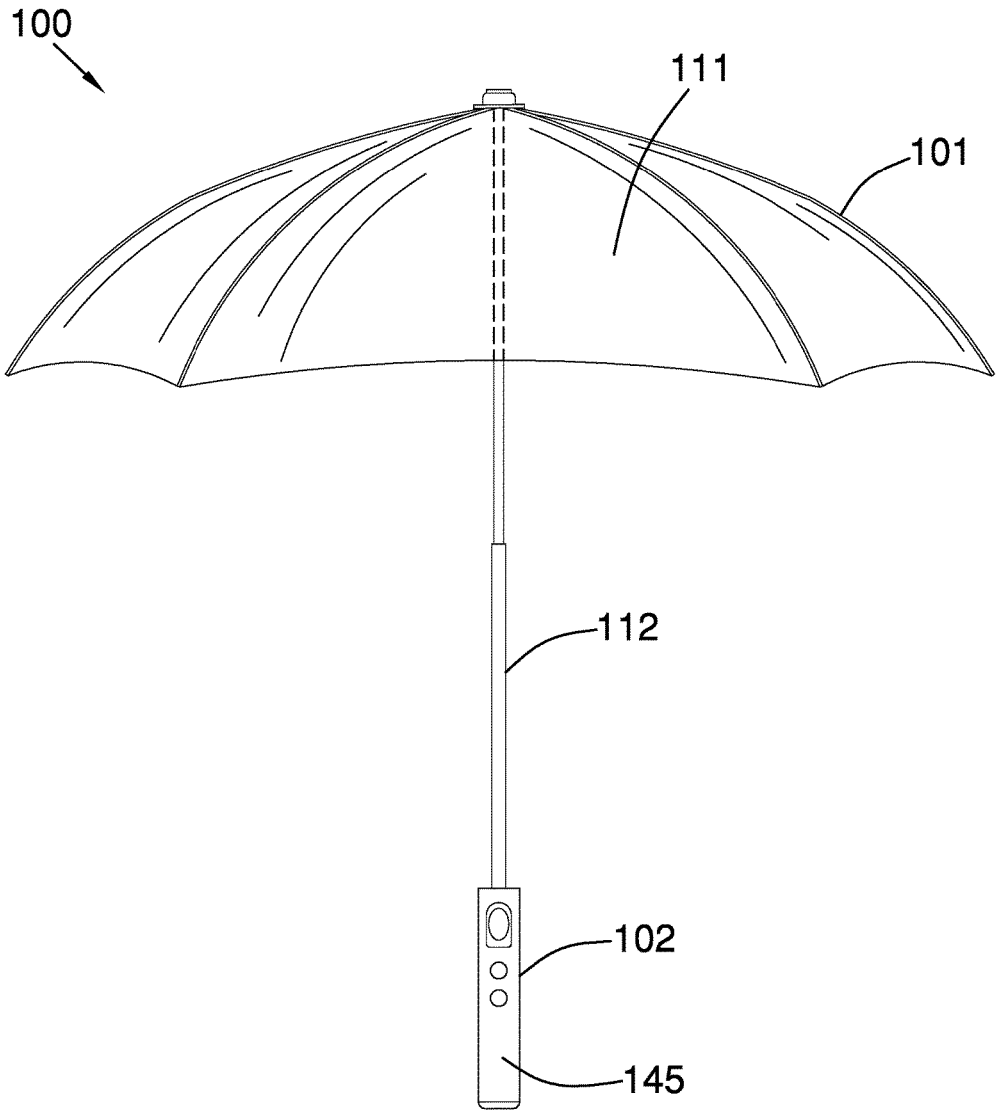
FIG. 3 is a front view of an embodiment of the disclosure.
Figure 4:
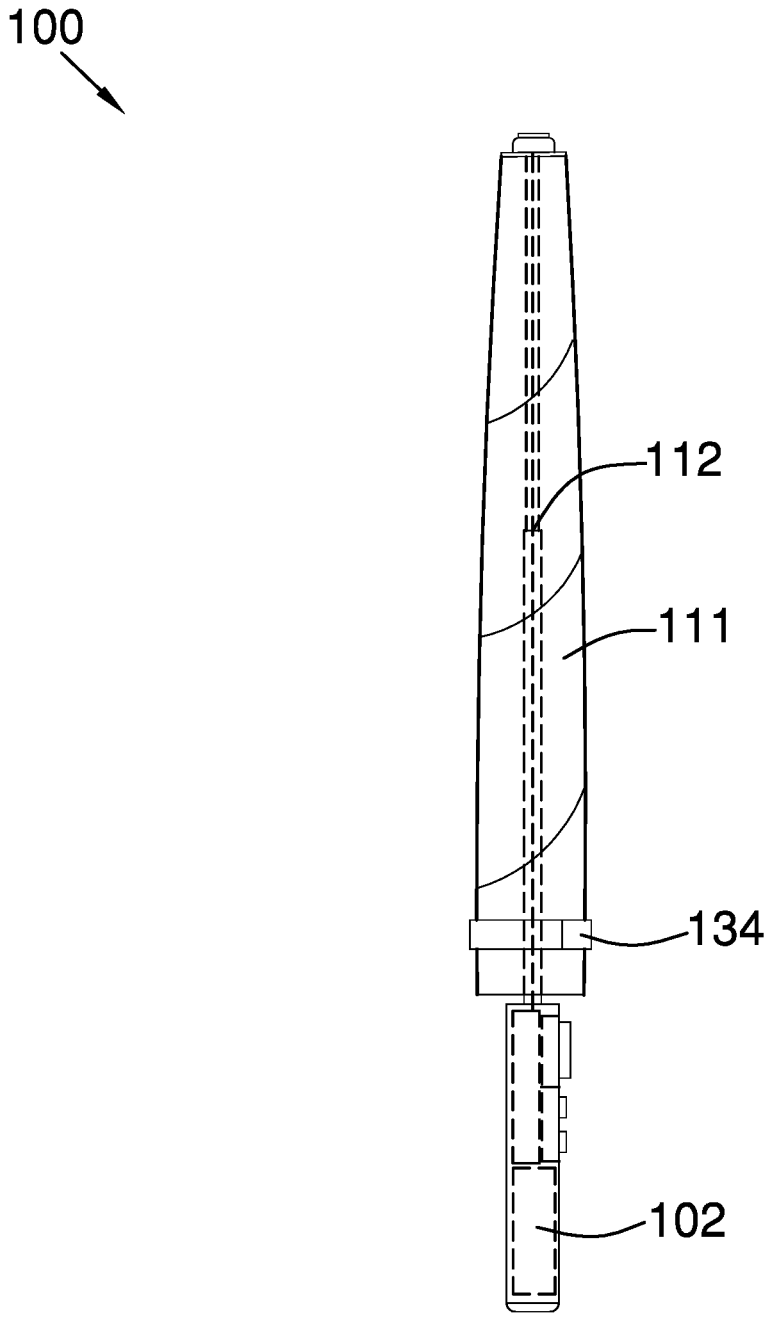
FIG. 4 is a side view of an embodiment of the disclosure.
Figure 5:
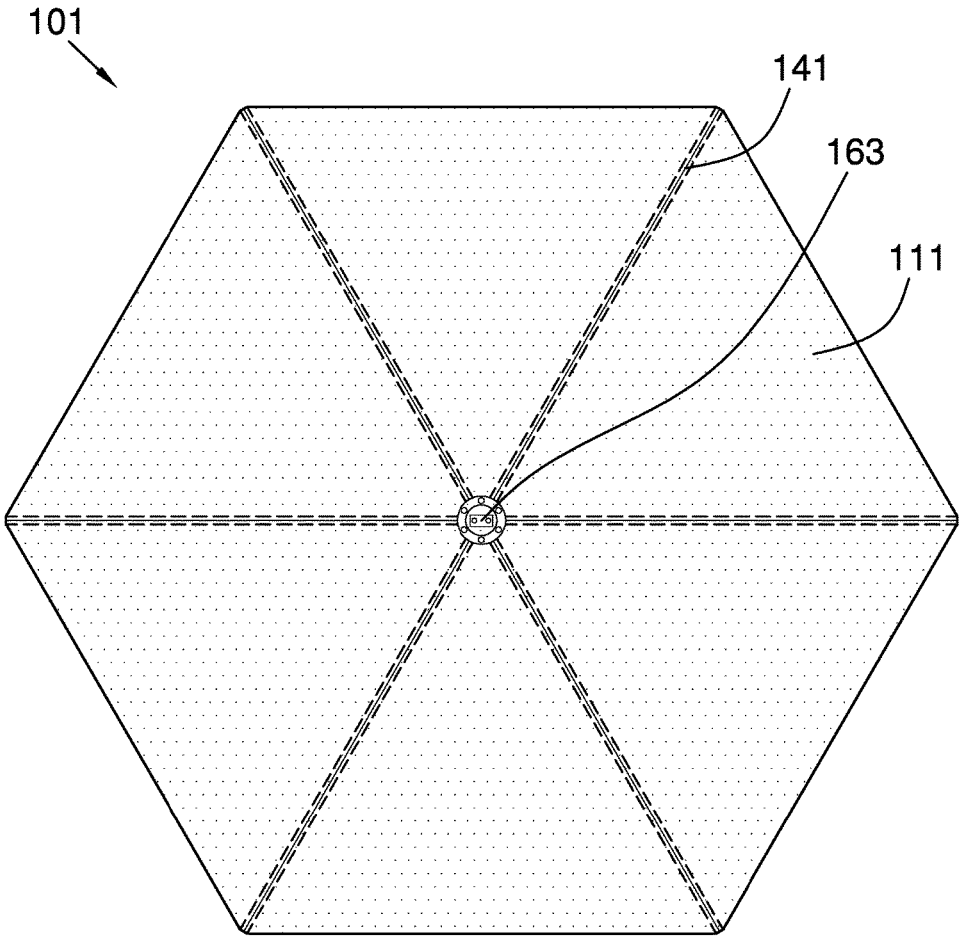
FIG. 5 is a top view of an embodiment of the disclosure.
Figure 6:
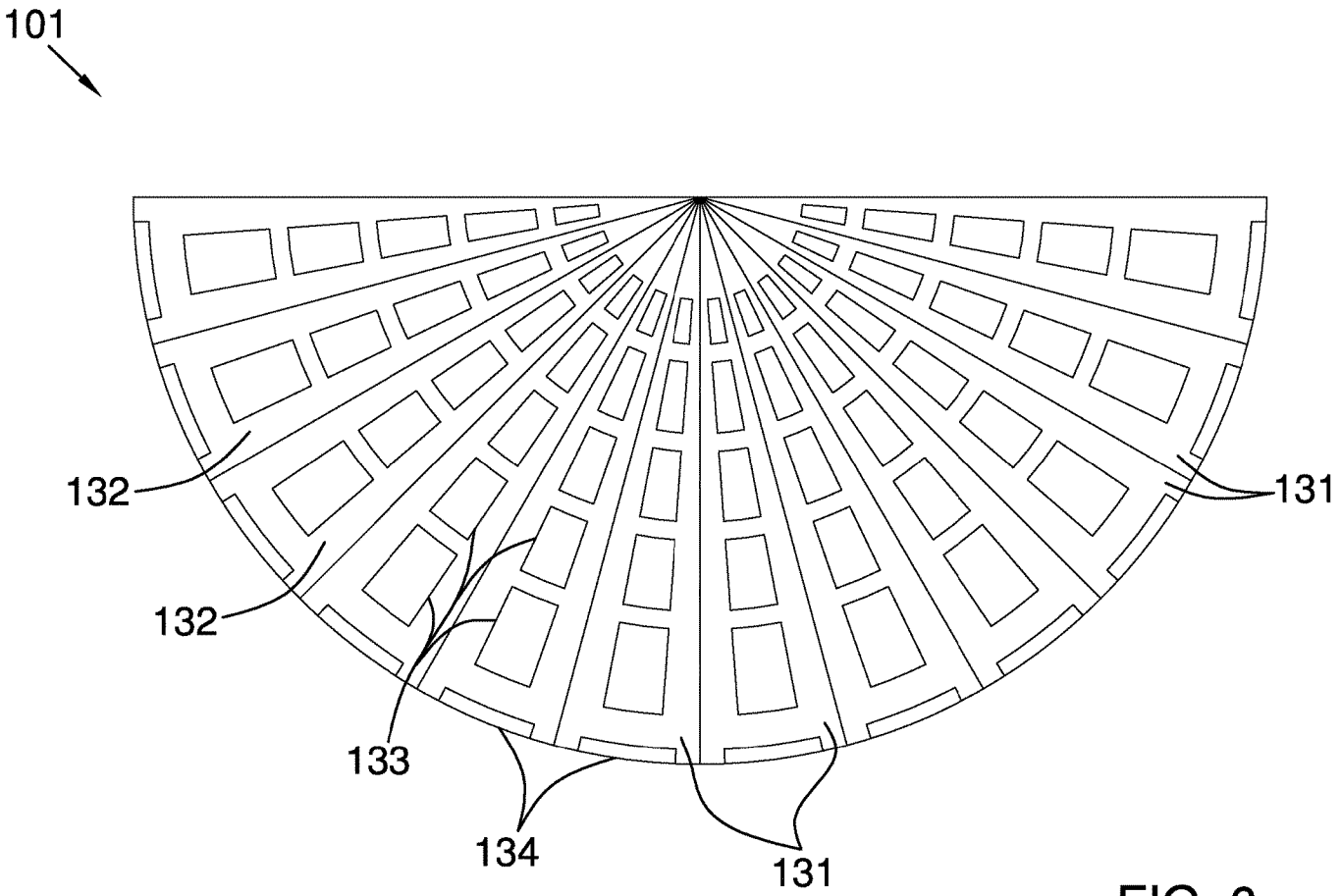
FIG. 6 is a detail view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 9.

The self defense umbrella 100 (hereinafter invention) is a safety device. The invention 100 is configured for use with a person. The invention 100 forms a defensive shield 101 that blocks and deflects an offensive projectile 191 directed at the person using the invention 100. The invention 100 comprises a shield 101 and a control system 102. The shield 101 forms a physical barrier that blocks and deflects an offensive projectile 191 directed at the person using the invention 100.

The control system 102: 1) captures images of the environment of the person using the invention 100; 2) determines the GPS coordinates of the person using the invention 100; 3) transmits the captured images and the GPS coordinates to an appropriate authority 172; 4) illuminates the environment of the person using the invention 100; and, 5) operates a defensive firearm 128 incorporated into the invention 100. Each invention 100 further comprises an interlocking mechanism that allows a plurality of inventions 100 to be interlocked to expand the volume of the protected space relative to the space protected by any individual self defense umbrella. The appropriate authority 172 is discussed in greater detail elsewhere in this disclosure.

The shield 101 is a vertical barrier structure. The shield 101 is a collapsible structure built in the structure of an umbrella. The shield 101 forms a physical barrier that blocks and deflects blows and projectiles directed at the person using the invention 100. The shield 101 is a paraboloid structure. The shield 101 is further defined with a focal point 194, a concave surface 195, and a convex surface 196. The focal point 194 is the mathematical focal point 194 of the paraboloid structure of the shield 101. During normal use of the invention 100, the concave surface 195 of the shield 101 is proximal to the person using the invention 100. The convex surface 196 is the surface of the paraboloid structure that is distal from the person using the invention 100.

Figure 9:
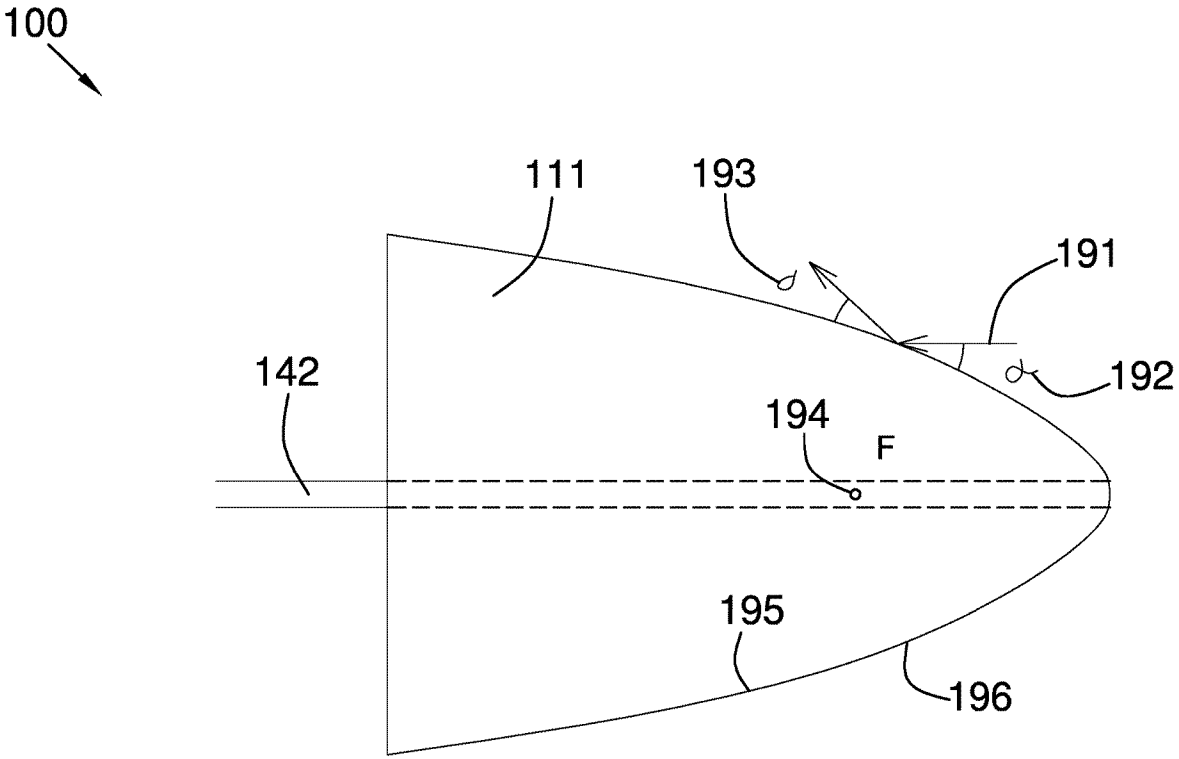
FIG. 9 is a detail view of an embodiment of the disclosure.

As shown most clearly in FIG. 9, the paraboloid structure of the shield 101 forms a reflective surface that deflects an offensive projectile 191 that is directed at the person using the invention 100 such that: 1) the incident angle 192 of contact of the offensive projectile 191 equals the reflected angle 193 of the deflected offensive projectile 191; and 2) the vector formed by the reflected angle 193 deflects the offensive projectile 191 in a direction away from the focal point 194 of the paraboloid structure of the shield 101.

Designing the paraboloid structure of the shield 101 in this manner creates a safe zone for the person using the invention 100 when the focal point 194 of the shield 101 is placed directly between the person using the invention 100 and the source of the offensive projectile 191.

The shield 101 comprises a canopy 111 and a frame 112.

The canopy 111 is a structure that absorbs and deflects the kinetic energy of the offensive projectile 191 in a direction away from the safe zone of the shield 101. The canopy 111 is a sheeting structure that forms the surface of the paraboloid structure when the invention 100 fully deploys. The canopy 111 attaches under tension to the frame 112.

The frame 112 is a titanium structure that holds and maintains the canopy 111 in the shape of the paraboloid structure when the invention 100 fully deploys. The physical structure of the frame 112 closely follows the physical structure of an umbrella. Any modifications to the frame 112 relative to a standard umbrella frame are intended to reinforce the frame 112 to withstand the kinetic energies to which the shield 101 is subjected. The frame 112 comprises a plurality of ribs 141, a plurality of stretchers 142, a runner 143, a center shaft 144, and a handle 145.

The canopy 111 comprises a plurality of panels 131. Each individual panel selected from the plurality of panels 131 comprises a plurality of textiles 132, a plurality of deflection plates 133, and a magnet 134. The plurality of textiles 132 comprises an outer textile layer 181, one or more protective textile layers 182, and a base textile layer 183.

The canopy 111 is assembled from the plurality of panels 131. The plurality of panels 131 is a collection of individual panels of a roughly triangular shape. Each individual panel selected from the plurality of panels 131: 1) is designed to absorb energy from the offensive projectile 191; and, 2) is designed to deflect the offensive projectile 191 in a direction away from the focal point 194 of the shield 101. Each individual panel selected from the plurality of panels 131 is a composite textile.

The plurality of textiles 132 comprises a minimum of three sheeting layers. Each sheeting layer contained within the plurality of textiles 132 is designed to: 1) absorb energy from the offensive projectile 191; 2) deflect the offensive projectile 191; and, 3) contain the plurality of deflection plates 133 within the individual panel. In the first potential embodiment of the disclosure, each of the plurality of textiles 132 comprises a commercially available poly-para-phenylene terephthalamide (CAS 25035-37-4) based textile. Methods to design, manufacture, and assemble ballistic materials as described in this paragraph are well known and documented in the textile and apparel arts.

In the first potential embodiment of the disclosure, the outer textile layer 181 is a commercially available textile that is specifically designed to absorb the energy of an offensive projectile 191. Each of the one or more protective textile layers 182 is a commercially available textile that is specifically designed to deflect the energy of an offensive projectile 191. Each of the one or more protective textile layers 182 is positioned between the plurality of deflection plates 133 and the outer textile layer 181. The base textile layer 183 is a commercially available textile that is specifically designed to deflect the energy of an offensive projectile 191. Each of the plurality of deflection plates 133 attaches to the base textile layer 183.

Figure 7:
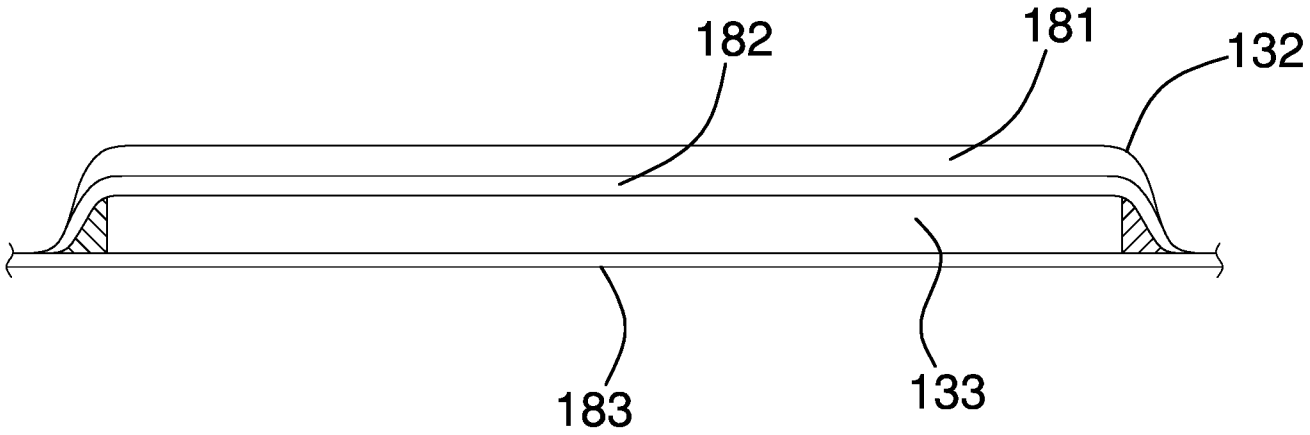
FIG. 7 is a detail view of an embodiment of the disclosure.
Figure 8:
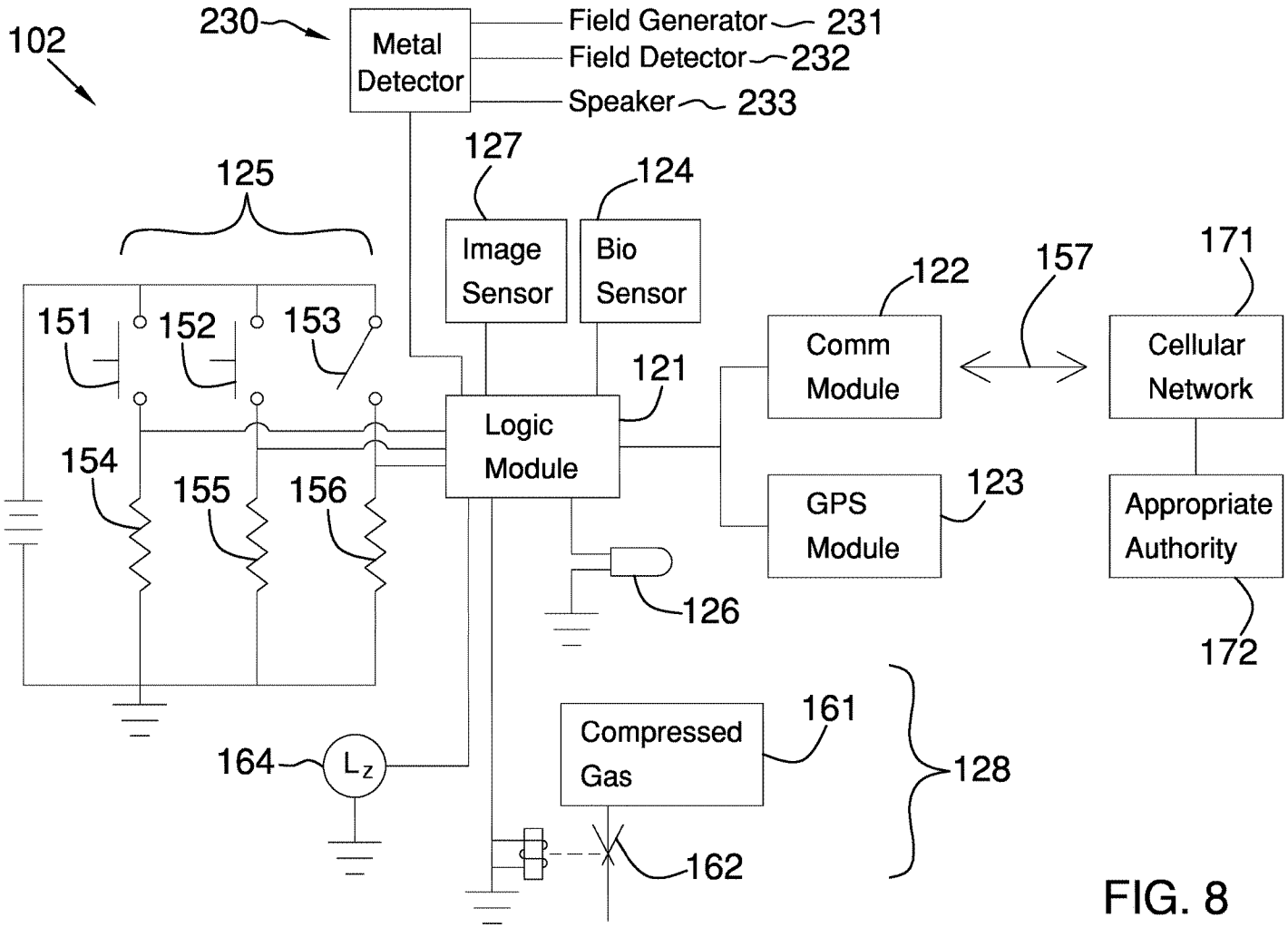
FIG. 8 is a block diagram or schematic view of an embodiment of the disclosure.

As shown most clearly in FIG. 7, the plurality of deflection plates 133 are layered between two adjacent textiles selected from the plurality of textiles 132. Each of the plurality of deflection plates 133 is a rigid plate structure that performs the function of armor. The plurality of deflection plates 133 forms a surface within each individual panel that absorbs and deflects the energy of the offensive projectile 191. As shown most clearly in FIG. 6, the plurality of deflection plates 133 are assembled in the manner of a mosaic in the sense that smaller individual plates are placed next to each other. The mosaic structure of the plurality of deflection plates 133 maximizes the surface area protected by the plurality of deflection plates 133 within the individual panel while allowing the individual panel to remain flexible within the overall structure of the canopy 111.

The magnet 134 is a neodymium magnet. The magnet 134 attaches to the individual panel along the section of the individual panel that forms the outer perimeter of the canopy 111. The magnet 134 of a first instantiation of the invention 100 is intended to attach to the magnet 134 of a second instantiation of the invention 100. By interconnecting the magnets 134 of two separate instantiations of the invention 100, multiple instantiations of the invention 100 may be joined to create a safe zone of increased size relative to the safe zone that is achievable by a single instantiation of the invention 100.

The canopy 111 is assembled by joining two panels to each rib selected from the plurality of ribs 141. Each of the plurality of ribs 141 joins a first panel selected from the plurality of panels 131 to a second panel selected from the plurality of panels 131. Each of the plurality of ribs 141 is identical. Each of the plurality of ribs 141 is formed such that the canopy 111 forms a paraboloid shape when the canopy 111 deploys. The use of a plurality of ribs 141 in an umbrella structure is well-known in the mechanical arts. Each of the plurality of stretchers 142 is used to separate the plurality of ribs 141 from the center shaft 144 when the canopy 111 deploys. The use of a plurality of stretchers 142 in an umbrella structure is well-known in the mechanical arts.

The runner 143 is a ring shaped device that attaches the plurality of stretchers 142 to the center shaft 144. The use of a runner 143 in an umbrella structure is well-known in the mechanical arts. The center shaft 144 is an extension structure that separates the canopy 111 from the person using the invention 100. The use of a center shaft 144 in an umbrella structure is well-known in the mechanical arts. The handle 145 is a grip that is used to manipulate the invention 100. The handle 145 attaches to the center shaft 144. The control system 102 is housed within the handle 145.

The control system 102 1) captures images of the environment of the person using the invention 100; 2) determines the GPS coordinates of the person using the invention 100; 3) transmits the captured images and the GPS coordinates to an appropriate authority 172; 4) illuminates the environment of the person using the invention 100; and, 5) operates a defensive firearm 128 incorporated into the invention 100. The control system 102 comprises a logic module 121, a communication module 122, a GPS module 123, a biometric sensor 124, a plurality of switches 125, a light 126, an image sensor 127, a firearm 128, a metal detector 230, and a battery 129.

The logic module 121 is a readily and commercially available programmable electronic device that is used to manage, regulate, and operate the control system 102. Depending on the specific design and the selected components, the logic module 121 can be a separate component within the control system 102 or the functions of the logic module 121 can be incorporated into another component within the control system 102. The communication module 122 is a wireless electronic communication device that allows the logic module 121 to wirelessly communicate with an appropriate authority 172. Specifically, the communication module 122 establishes a wireless communication link 157 between the control system 102 and the appropriate authority 172.

The communication module 122 communicates SMS and MMS messages between the logic module 121 and the appropriate authority 172 through a commercially provided and publicly available cellular wireless network 171. The use of a commercially provided and publicly available cellular wireless network 171 is preferred because: 1) of its low cost; 2) of the widespread availability and the broad interoperability between competing commercially provided and publicly available cellular wireless networks 171; and, 3) methods and techniques to send SMS and MMS messages over a commercially provided and publicly available cellular wireless network 171 are well known and documented by those skilled in the electrical arts. The commercially provided and publicly available cellular wireless network 171 will typically refer to a cellular phone network.

The GPS module 123 is an electrical device that communicates with the GPS to determine the GPS coordinates of the GPS module 123. When queried by the logic module 121, the GPS module 123 transfers the GPS coordinates to the logic module 121.

The biometric sensor 124 is a security device that limits access to the control system 102 to a previously identified person. In the first potential embodiment of the disclosure, the biometric sensor 124 is a readily and commercially available fingerprint scanner that: 1) scans and digitally represents a fingerprint; and 2) transmits the digital representation of the fingerprint to the logic module 121. The logic module 121 validates the transmitted fingerprint before allowing operational access to the control system 102.

The plurality of switches 125 are control interfaces accessible to the person using the invention 100 to access the control system 102. In the first potential embodiment of the disclosure, the plurality of switches 125 comprises a light switch 151, a trigger switch 152, and a deployment switch 153. The light 126 is a lamp that is used to illuminate the space in front of the convex surface 196 of the shield 101. The light 126 is controlled using a light switch 151.

The light switch 151 is a normally open momentary switch that electrically connects in series between the battery 129 and a first pull down resistor 154. The light switch 151 signals the logic module 121 to turn on and off the light 126. The trigger switch 152 is a normally open momentary switch that electrically connects in series between the battery 129 and a second pull down resistor 155. The trigger switch 152 signals the logic module 121 to actuate a solenoid valve 162 to release the compressed gas cylinder 161 in order to fire the defensive projectile 163. The deployment switch 153 is a maintained switch that closes when the canopy 111 deploys. The deployment switch 153 electrically connects in series between the battery 129 and a third pull down resistor 156. The deployment switch 153 signals to the logic module 121 that the operation of the control system 102 should be initiated. The defensive projectile 163 further comprises a laser aiming device 164. The laser aiming device 164 is illuminated by the logic module 121 when the deployment switch 153 is activated. The laser aiming device 164 is aligned with the anticipated trajectory of the defensive projectile 163 such that the laser aiming device 164 will illuminate the anticipated impact point of the defensive projectile.

The first pull down resistor 154 is a pull-down resistor that presents a voltage to the logic module 121 when the light switch 151 is closed. The voltage across the first pull down resistor 154 is monitored by the logic module 121. The second pull down resistor 155 is a pull-down resistor that presents a voltage to the logic module 121 when the trigger switch 152 is closed. The voltage across the second pull down resistor 155 is monitored by logic module 121. The third pull down resistor 156 is a pull-down resistor that presents a voltage to the logic module 121 when the deployment switch 153 is closed. The voltage across the third pull down resistor 156 is monitored by the logic module 121.

The image sensor 127 is a sensor that: 1) captures images from the space illuminated by the light 126; 2) generates a digital representation of the captured image; and, 3) transmits the digital representation to the logic module 121 for transmission to the appropriate authority 172.

The firearm 128 is a device that projects a defensive projectile 163 towards the source of an offensive projectile 191. The firearm 128 comprises a compressed gas cylinder 161, a solenoid valve 162, and a defensive projectile 163.

The compressed gas cylinder 161 is a commercially available cylinder of compressed gas that is used to provide a motive force to the defensive projectile 163. The solenoid valve 162 controls the release of the compressed gas contained within the compressed gas cylinder 161. As shown most clearly in FIG. 8, the logic module 121 energizes the coil of the solenoid valve 162 when the trigger switch 152 is closed.

The solenoid valve 162 is not directly operated by the trigger switch 152 for security reasons. Specifically, the logic module 121 will only energize the coil of the solenoid valve 162 after a user has been authorized using the biometric sensor 124. The solenoid valve 162 is sized to allow the compressed gas cylinder 161 to decompress explosively.

The defensive projectile 163 is fired away from the invention 100 using the compressed gas cylinder 161 and the solenoid valve 162. In the first potential embodiment of the disclosure, the defensive projectile 163 is selected from the group consisting of a tear gas canister or the electrodes from a Taser.

The metal detector 230 is a commercially available device. The operation of the metal detector 230 is initiated by the logic module 121. The metal detector 230 generated an audible alarm when metal is detected in front of the convex surface 196 of the shield 101. The metal detector comprises a field generator 231, a field detector 232, and a speaker 233. The field generator 231 generates an electrical field of a known geometry in front of the convex surface 196 of the shield 101. The field detector 232 detects the disruption in the geometry of the electric field when a metal object enters the electric field. When the field detector 232 detects this electric field disruption, the speaker 233 is activated to generate a clearly audible alarm.

The battery 129 is a chemical device that provides the electrical energy required to operate the control system 102.

The following definitions were used in this disclosure:

Appropriate Authority: As used in this disclosure, an appropriate authority is a previously determined person or organization that is designated to receive an alarm or other notification messages regarding a monitored system or activity.

Battery: As used in this disclosure, a battery is a chemical device consisting of one or more cells, in which chemical energy is converted into electricity and used as a source of power.

Biometric Device: As used in this disclosure, a biometric device is a security device that identifies an individual through the use of a unique and measurable physiological characteristic of the individual. Typical unique and measurable physiological characteristic include, but are not limited to, fingerprints, DNA, or retina of the eye.

Bottom Tip Spring: As used in this disclosure, a bottom tip spring is a component of an umbrella that is used to hold the runner is a position that retracts the canopy of the umbrella. A typical bottom tip spring arrangement comprises a triangular piece of metal attached to a spring that pushes the triangular piece of metal away from the shaft. The triangular piece of metal is positioned to allow the runner to pass over the bottom tip spring in one direction only. To move the runner in the opposite direction requires that the triangular piece of metal be pushed towards the shaft. Typically, an umbrella is fitted with a bottom tip spring and a top tip spring.

Camera: As used in this disclosure, a camera is a sensor that converts light into electric signals that encode and records the spatial orientation of the captured light in a manner that reproduces the images seen by a human eye.

Channel: As used in this disclosure, a channel is a tubular passage through which an object or fluid is passed through.

Composite Textile: As used in this disclosure, a composite textile is a multilayer fabric made of two or more joined layers of textile or sheeting materials.

Compress: In this disclosure, to compress means to force into a smaller space.

Compressed Gas: In this disclosure, compressed gas refers to a gas that has been compressed to a pressure greater than atmospheric pressure.

Concave: As used in this disclosure, concave is used to describe: 1) a surface that resembles the interior surface of a sphere; or, 2) a function with a curvature structure wherein a chord that connects any two points of the function will be lesser than (graphically below) or equal to the value of the function at any point along the chord.

Control System: As used in this disclosure, a control system is a first device or system that manages and regulates the behavior or operation of a second device or system.

Convex: As used in this disclosure, convex is used to describe: 1) a surface that resembles the outer surface of a sphere; or, 2) a function with a curvature structure wherein a chord that connects any two points of the function will be greater than (graphically above) or equal to the value of the function at any point along the chord.

Extension Structure: As used in this disclosure, an extension structure is an inert physical structure that is used to extend the span of the distance between any two objects.

Focal Point: As used in this disclosure, a focal point is a physical location along an axis of symmetry of an optical system comprising lenses or mirrors wherein: 1) a plurality of parallel rays that are processed by the optical system comprising lenses or mirrors appears to converge; or, 2) a plurality of parallel rays that are processed by the optical system comprising lenses or mirrors appears to diverge.

Firearm: As used in this disclosure, a firearm is a handheld weapon designed to expel a projectile which has been accelerated using a mechanism comprising an explosion or an explosive decompression.

GPS: As used in this disclosure, and depending on the context, GPS refers to: 1) a system of navigational satellites that are used to determine the position and velocity of a person or object; 2) the system of navigational satellites referred to in the first definition that is used to synchronize to global time; or, 3) an electronic device or that uses the system of navigational satellites referred to in the first definition to determine the position of a person or object. GPS is an acronym for Global Positioning System.

Image: As used in this disclosure, an image is an optical representation or reproduction of an indicia or of the appearance of something or someone.

Image Sensor: As used in this disclosure, an image sensor receives light from the exterior of the image sensor and converts the received light into a digital representation of sufficient detail to allow a logic module to create and display a visual reproduction of the source of the captured light.

Light: As used in this disclosure, a light is an electrical device that generates visible light to illuminate objects so they can be seen.

Logic Module: As used in this disclosure, a logic module is a readily and commercially available electrical device that is programmable and that accepts digital and analog inputs, processes the digital and analog inputs according to previously stored instruction and provides the results of these instructions as digital or analog outputs.

Magnet: As used in this disclosure, a magnet is an ore, alloy, or other material that has its component atoms arranged so the material exhibits properties of magnetism such as attracting other iron-containing objects or aligning itself with an external magnetic field.

Magnetic Material: As used in this disclosure, a magnetic material is a substance that attracts or is attracted to a magnet but that itself has no net magnetic moment (beyond any residual moment created by prior use). Common classes of magnetic materials include ferromagnetic, diamagnetic, paramagnetic, ferrimagnetic and antiferromagnetic.

Maintained Switch: A used in this disclosure, a maintained switch is a switch that maintains the position that was set in the most recent switch actuation. A maintained switch works in an opposite manner to a momentary switch.

Momentary Switch: As used in this disclosure, a momentary switch is a biased switch in the sense that the momentary switch has a baseline position that only changes when the momentary switch is actuated (for example when a push button switch is pushed). The momentary switch then returns to the baseline position once the actuation is completed. This baseline position is called the "normal" position. For example, a "normally open" momentary switch interrupts (open) the electric circuit in the baseline position and completes (closes) the circuit when the momentary switch is activated. Similarly, a "normally closed" momentary switch will complete (close) an electric circuit in the baseline position and interrupt (open) the circuit when the momentary switch is activated.

Neodymium: As used in this disclosure, Neodymium refers to the chemical element with atomic number 60. Neodymium is a metal in the lanthanide row of the periodic table. Neodymium is commonly used to make alloys and magnets.

Parabola: As used in this disclosure, a parabola is a curve described by the equation: $y=ax^2+bx+c$.

Paraboloid: As used in this disclosure, a paraboloid is a quadric surface formed from the surface of rotation of a parabola.

Plate: As used in this disclosure, a plate is a smooth, flat and semi-rigid or rigid structure that has at least one dimension that: 1) is of uniform thickness; and, 2) that appears thin relative to the other dimensions of the object. Plates often have a rectangular or disk like appearance. As defined in this disclosure, plates may be made of any material, but are commonly made of metal. When made of wood, a plate is often referred to as a board.

Runner: As used in this disclosure, a runner is a component of an umbrella that fits over the center post of the umbrella. Stretchers are used to connect the ribs of the umbrella to the runner which in turn connects the runner to the center post. By raising the runner, the stretchers expand the ribs to create a structure upon which the canopy of the umbrella is placed.

Sensor: As used in this disclosure, a sensor is a device that receives and responds in a predetermined way to a signal or stimulus.

Sheeting: As used in this disclosure, a sheeting is a material, such as a textile, a plastic, or a metal foil, in the form of a thin flexible layer or layers.

Solenoid: As used in this disclosure, a solenoid is a cylindrical coil of electrical wire that generates a magnetic field that can be used to mechanically move a shaft made of a magnetic core.

Solenoid Valve: As used in this disclosure, a solenoid valve is an electromechanically controlled valve that is used to control fluid or gas flow. A two port solenoid valve opens or closes to fluid flow through the valve portion of the solenoid valve. A three port solenoid valve switched fluid or gas flow between a first port and a second port to either feed or be fed from a third port.

SMS: As used in this disclosure, SMS is an abbreviation for short message service. The short message service is a service that is often provided with the cellular services that support personal data devices. Specifically, the SMS allows for the exchange of written messages between personal data devices. The SMS is commonly referred to as text messaging. A common enhancement of SMS is the inclusion of the delivery of multimedia services. This enhanced service is often referred to as Multimedia Media Services which is abbreviated as MMS.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Textile: As used in this disclosure, a textile is a material that is woven, knitted, braided or felted. Synonyms in common usage for this definition include fabric and cloth.

Top Tip Spring: As used in this disclosure, a top spring is a component of an umbrella that is used to hold the runner is a position that extends the canopy of the umbrella. A typical top spring arrangement comprises a triangular piece of metal attached to a spring that pushes the triangular piece of metal away from the shaft. The triangular piece of metal is positioned to allow the runner to pass over the top tip spring in one direction only. To move the runner in the opposite direction requires that the triangular piece of metal be pushed towards the shaft. Typically, an umbrella is fitted with a bottom tip spring and a top tip spring.

Umbrella: As used in this disclosure, an umbrella is a device used for protection against the weather comprising a (typically circular) canopy made of a textile or sheeting that is mounted on a folding metal frame that is supported by a central rod.

Valve: As used in this disclosure, a valve is a device that is used to control the flow of a fluid (gas or liquid) through a pipe.

With respect to the above description, it is to be realized that the optimum dimensional relationship for the various components of the invention described above and in FIGS. 1 through 9 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A personal safety device comprising:
a shield and a control system;
wherein the shield is a physical barrier;
wherein the control system captures images of the environment around the personal safety device;
wherein the control system determines GPS coordinates of the personal safety device;
wherein the control system transmits the captured images and the GPS coordinates to an appropriate authority;
wherein the control system illuminates the environment around the personal safety device;
wherein the personal safety device deflects an offensive projectile;
wherein the personal safety device absorbs said offensive projectile;
wherein the shield is a vertical physical barrier;
wherein the shield is a collapsible structure;
wherein the shield is built in the manner of an umbrella;
wherein the physical barrier blocks deflects an offensive projectile;
wherein the physical barrier absorbs an offensive projectile;
wherein the shield is a paraboloid structure;
wherein the shield is further defined with a focal point, a concave surface, and a convex surface.

2. The personal safety device according to claim 1
wherein the shield comprises a canopy and a frame;

wherein the canopy attaches to the frame;
wherein the canopy absorbs the kinetic energy of the offensive projectile;
wherein the canopy deflects the kinetic energy of the offensive projectile.

3. The personal safety device according to claim 2
wherein the canopy is a sheeting structure;
wherein the canopy forms a surface of the paraboloid structure;
wherein the canopy attaches under tension to the frame;
wherein the frame holds the canopy in the shape of the paraboloid structure.

4. The personal safety device according to claim 3
wherein the frame comprises a plurality of ribs, a plurality of stretchers, a runner, a center shaft, and a handle;
wherein the plurality of stretchers attach the plurality of ribs to the runner;
wherein the runner attaches the plurality of stretchers to the center shaft;
wherein the handle attaches to the center shaft;
wherein the control system is contained within the handle.

5. The personal safety device according to claim 4
wherein the canopy comprises a plurality of panels;
wherein each said individual panel selected from the plurality of panels comprises a plurality of textiles, a plurality of deflection plates, and a magnet;
wherein the plurality of deflection plates and the magnet attach to the plurality of textiles;
wherein each said individual panel selected from the plurality of panels has a triangular shape;
wherein each said individual panel selected from the plurality of panels is a composite textile;
wherein each said individual panel selected from the plurality of panels absorbs energy from the offensive projectile;
wherein each said individual panel selected from the plurality of panels deflects the offensive projectile in a direction away from the focal point of the shield.

6. The personal safety device according to claim 5
wherein the plurality of textiles comprises at least three sheeting layers;
wherein said one or more sheeting layers contained within the plurality of textiles absorbs energy from the offensive projectile;
wherein said one or more sheeting layers contained within the plurality of textiles deflects the offensive projectile;
wherein the plurality of deflection plates attaches to said one or more sheeting layers.

7. The personal safety device according to claim 6
wherein the plurality of textiles comprises an outer textile layer, one or more protective textile layers, and a base textile layer;
wherein the outer textile layer absorbs the energy of said offensive projectile;
wherein each of the one or more protective textile layers deflects the energy of an offensive projectile;
wherein the base textile layer deflects the energy of said offensive projectile.

8. The personal safety device according to claim 7
wherein each of the one or more protective textile layers is positioned between the plurality of deflection plates and the outer textile layer;
wherein each of the plurality of deflection plates attaches to the base textile layer.

9. The personal safety device according to claim 8
wherein each of the plurality of deflection plates is a rigid plate structure;
wherein the plurality of deflection plates forms a surface within each said individual panel that absorbs the energy of the offensive projectile;
wherein the plurality of deflection plates forms a surface within each individual panel that deflects the energy of the offensive projectile;
wherein the plurality of deflection plates are assembled as a mosaic.

10. The personal safety device according to claim 9
wherein the magnet is a neodymium magnet;
wherein the magnet attaches to the individual panel along the section of the individual panel that forms the outer perimeter of the canopy;
wherein the magnet of a first instantiation of the personal safety device attaches to the magnet of a second instantiation of the personal safety device.

11. The personal safety device according to claim 10
wherein each of the plurality of ribs joins a first panel selected from the plurality of panels to a second panel selected from the plurality of panels;
wherein each of the plurality of ribs is identical;
wherein each of the plurality of ribs is formed such that the canopy forms a paraboloid;
wherein each of the plurality of stretchers separates the plurality of ribs from the center shaft;
wherein the runner is a ring shaped device;
wherein the center shaft is an extension structure;
wherein the handle attaches to the center shaft;
wherein the center shaft separates the canopy from the handle.

12. The personal safety device according to claim 11
wherein the control system comprises a logic module, a communication module, a GPS module, a biometric sensor, a plurality of switches, a light, an image sensor, a metal detector, and a battery;
wherein the logic module, the communication module, the GPS module, the biometric sensor, the plurality of switches, the light, the image sensor, the firearm, the metal detector, and the battery are electrically interconnected.

13. The personal safety device according to claim 12
wherein the logic module is a programmable electronic device;
wherein the communication module is a wireless electronic communication device;
wherein the communication module establishes a wireless communication link between the control system and the appropriate authority;
wherein the communication module communicates short message services (hereinafter SMS) and multimedia media services (hereinafter MMS) messages between the logic module and the appropriate authority through a commercially provided and publicly available cellular wireless network;
wherein the GPS module is an electrical device that communicates with the GPS to determine the GPS coordinates of the GPS module;
wherein the GPS module transfers the GPS coordinates to the logic module;
wherein the biometric sensor is a security device that limits access to the control system;
wherein the plurality of switches are control interfaces for the control system;
wherein the light is a lamp that illuminates the environment in front of the convex surface of the shield;
wherein the image sensor is a sensor captures images from the space illuminated by the light wherein the image sensor generates a digital representation of the captured image;

wherein the image sensor transmits the digital representation to the logic module for transmission to the appropriate authority;

wherein the metal detector senses the presence of metal in front of the convex surface of the shield.

14. The personal safety device according to claim 13 wherein the plurality of switches comprises a light switch, a trigger switch, and a deployment switch;

wherein the light switch is a normally open momentary switch that electrically connects in series between the battery and a first pull down resistor;

wherein the light switch signals the logic module to turn on and off the light;

wherein the first pull down resistor is a pull-down resistor that presents a voltage to the logic module when the light switch is closed;

wherein the voltage across the first pull down resistor is monitored by the logic module;

wherein the trigger switch is a normally open momentary switch that electrically connects in series between the battery and a second pull down resistor;

wherein the trigger switch signals the logic module to actuate a solenoid valve to release the gas in the compressed gas cylinder;

wherein the second pull down resistor is a pull-down resistor that presents a voltage to the logic module when the trigger switch is closed;

wherein the voltage across the second pull down resistor is monitored by the logic module;

wherein the deployment switch is a maintained switch that closes when the canopy deploys;

wherein the deployment switch electrically connects in series between the battery and a third pull down resistor;

wherein the deployment switch signals to the logic module to initiate the operation of the control system;

wherein the third pull down resistor is a pull-down resistor that presents a voltage to the logic module when the deployment switch is closed;

wherein the voltage across the third pull down resistor is monitored by the logic module.

15. The personal safety device according to claim 14 wherein the control system further comprises a firearm;

wherein firearm electrically interconnects with the logic module, the communication module, the GPS module, the biometric sensor, the plurality of switches, the light, the image sensor, and the battery are electrically interconnected;

wherein the firearm is a device that projects a defensive projectile towards a source of said offensive projectile;

wherein the firearm further comprises laser targeting.

16. The personal safety device according to claim 15 wherein the firearm comprises a compressed gas cylinder, a solenoid valve, and said defensive projectile;

wherein the compressed gas cylinder generates a motive force to the defensive projectile;

wherein the solenoid valve controls the release of the compressed gas contained within the compressed gas cylinder;

wherein the solenoid valve is sized to allow the compressed gas cylinder to decompress explosively;

wherein the defensive projectile is a tear gas canister or electrodes from a tazer.

17. The personal safety device according to claim 16 wherein the plurality of switches further comprises a trigger switch;

wherein the trigger switch is a normally open momentary switch that electrically connects in series between the battery and said second pull down resistor;

wherein the trigger switch signals the logic module to actuate the solenoid valve to release the compressed gas cylinder;

wherein the second pull down resistor is a pull-down resistor that presents a voltage to the logic module when the trigger switch is closed;

wherein the voltage across the second pull down resistor is monitored by the logic module.

18. The personal safety device according to claim 17 wherein the biometric sensor is a fingerprint scanner;

wherein the logic module validates the transmitted fingerprint before allowing operational access to the control system;

wherein the logic module will only energize the coil of the solenoid valve after a user has been authorized using the biometric sensor.

19. The personal safety device according to claim 18 wherein each of the plurality of textiles comprises a commercially available poly-para-phenylene terephthalamide based textile.

* * * * *